United States Patent [19]

Northup et al.

[11] 4,296,670

[45] Oct. 27, 1981

[54] ORDNANCE RECOIL ENERGY CONTROL AND RECOVERY SYSTEM

[75] Inventors: Robert P. Northup; Robert L. Anderson, both of Pittsfield, Mass.

[73] Assignee: General Electric Company, Schenectady, N.Y.

[21] Appl. No.: 53,336

[22] Filed: Jun. 29, 1979

[51] Int. Cl.[3] ..... F41F 19/14

[52] U.S. Cl. ..... 89/43 R

[58] Field of Search ..... 89/4 R, 4 A, 4 B, 43 R, 89/43 A

[56] References Cited

U.S. PATENT DOCUMENTS

| | | | |
|---|---|---|---|
| 2,410,116 | 10/1946 | Vickers | 89/4 B |
| 3,144,809 | 8/1964 | Girouard et al. | 89/4 R |
| 3,146,672 | 9/1964 | Girouard et al. | 89/43 R |
| 3,638,526 | 5/1969 | Klapdohr | 89/43 R |
| 3,964,365 | 6/1976 | Zielinski | 89/43 R |
| 4,088,059 | 5/1978 | Hayner | 89/43 A |

FOREIGN PATENT DOCUMENTS 14933 of 1911 United Kingdom ..... 89/4 A

OTHER PUBLICATIONS

"5 Inch 54 Calibre Mark 45 Gun Mount for U.S. Navy", International Defense Review, 1/1970, p. 186.

"76/62 Compact OTO Automatic Gun", OTO Melara SpA, 8/16/74, pp. 13–15, 32–33.

*Primary Examiner*—Stephen C. Bentley

*Attorney, Agent, or Firm*—Francis K. Richwine

[57] ABSTRACT

Ordnance recoil mechanism for controlling, collecting and storing firing reaction energy and for returning the recoil mass to battery by means of stored reaction energy including structure for storing energy not used in counterrecoil and making that stored energy available for use subsequent to return to battery of the recoil mass.

15 Claims, 5 Drawing Figures

ORDNANCE RECOIL ENERGY CONTROL AND RECOVERY SYSTEM

The United States Government has rights in this invention pursuant to Department of Navy Contract N60921-77-C-A059.

BACKGROUND OF THE INVENTION

1. Field of the Invention

This invention pertains to recoil systems for ordnance and particularly to recoil systems for intermediate and large caliber guns. More specifically, the invention pertains to the recovery and utilization of the reaction energy developed by the firing of such guns.

2. Description of the Prior Art

Since the early 1900's, intermediate and heavy ordnance, particularly guns in the 75 mm and larger sizes, have consisted of two primary components, the recoil mass which moves in reaction to firing and the gun mount which remains stationary. The two components are interconnected by a recoil mechanism which permits absorption of the recoil forces and provides for return of the recoil mass to battery, or firing position. Recoil systems which include both the mechanism for absorbing or dissipation of the reaction energy from the firing of the gun and also for driving the counterrecoil mechanism to return the gun to battery have included mechanical, hydraulic and gaseous systems or combinations thereof. One very common type of system is mechanical, using a spring to absorb energy, with or without hydraulic dampening or mechanical buffer structures to control recoil and to store and later release a sufficient amount of energy to drive the recoil mass in the counterrecoil or "run out" action. Even the modern OTO Melara 76 mm, 62 caliber compact mount, recently adopted by the United States Navy as the Mark 75, and the larger similar OTO Melara 127 mm fast-firing gun use a mechanical spring driven system of this type. Another example is the United States Navy Mark 42 5", 54 caliber gun which includes a hydraulic recoil system which forms the subject matter of U.S. Pat. No. 3,146,672 (EH Girouard et al, issued Sept. 1, 1964). This mechanism includes a hydraulic pump for the direct pumping of a hydraulic fluid on recoil into a high pressure accumulator which simultaneously serves to slow the recoil mass and store energy in an accumulator. Thereafter, the energy stored in the accumulator is used to move the recoil mass in counterrecoil motion to battery and to provide some additional energy to relieve the associated high pressure hydraulic pump powered by outside energy during periods of high usage. A slightly different system is found in H. F. Vickers U.S. Pat. No. 2,410,116 where a recoil pumped hydraulic accumulator system is used to power the breech block, the extractor and the rammer (counterrecoil is apparently spring driven). Another system is a German system forming the subject matter of U.S. Pat. No. 3,964,365 (Zielinski, issued June 22, 1976, assigned to Rheinmetall) which also constitutes a direct pumping hydraulic system which stores recoil energy hydraulically in an accumulator, whereafter that energy is released during counterrecoil to return the gun to battery and is also used in part to drive an auxiliary mechanism. However, Zielinski's system does not have any provision for storage or use of recoil-generated energy after return of the recoil mass to battery. Another typical gun system is the Mark 45 5", 54 caliber used by the United States Navy. This system uses a direct pumping hydraulic accumulator which is charged on recoil but all of the energy is either dissipated or used for counterrecoil. The Mark 45 also uses a plurality of additional exteriorly charged hydraulic systems for driving mount subsystems for loading, ramming and positioning. One other system, U.S. Pat. No. 3,638,526 (Klapdohr, Feb. 1, 1972, assigned to Rheinmetall), is noted because it includes a free piston serving to transfer pressure between a gas and hydraulic oil. However, Klapdohr's system is not analogous in that it is merely a gun or gun barrel handling system for moving a gun in and out of battery when not fired. Klapdohr discloses a system for applying energy from another source to move a gun barrel. Applicants collect, store and distribute energy resulting from recoil on firing. Applicants are not away of systems other than that of U.S. Pat. No. 2,410,116 and the Mark 42 which recover and use recoil energy for anything other than "run out" or servicing of the gun, are not aware of any system which uses other than a direct pumped hydraulic or mechanical system, and do not know of any prior use of the combination of a gaseous recuperator which would, in addition to powering counterrecoil, also charge a hydraulic accumulator for storage of energy for subsequent use.

SUMMARY OF THE INVENTION

This invention is directed to a recoil energy control and recovery system for ordnance which recovers and stores energy produced by recoil of the gun on firing and, thereafter, uses the stored energy for both "run out" and other purposes. In addition, this invention provides a gas operated system in which the recoil energy is first recovered and stored in a recuperator with the energy in excess of that needed for counterrecoil being transferred to an accumulator in a hydraulic system after counterrecoil so as to avoid the direct recoil pumping of hydraulic fluid and its inherent inefficiencies. Use of the two-stage system is more efficient than direct pumping as recoil energy can be stored more readily by pressurizing gas with less frictional loss and thereafter using the gas pressure to more slowly charge the accumulator in the hydraulic system.

In general, the invention contemplates a three-step action for harnessing and storing ordnance recoil energy. The recoil energy first moves the recoil mass to reduce the volume of a gas-filled chamber, forcing the gas into a recuperator to increase the pressure in the recuperator. The pressurized gas is then used to drive the recoil mass back to battery while returning the gas-filled chamber to only a portion of its original volume. Finally, the excess energy stored in the compressed gas in the recuperator is used to pump hydraulic fluid by expansion of the gas-filled chamber to its original size with a comparable decrease in size of a hydraulic cylinder as, for example, through the use of a double-acting piston. The transfer of the energy from the recuperator to the hydraulic system at a rate independent of the recoil rates permits selection of a hydraulic pumping rate that minimizes energy losses.

DESCRIPTION OF THE PREFERRED EMBODIMENTS

Figure 1:
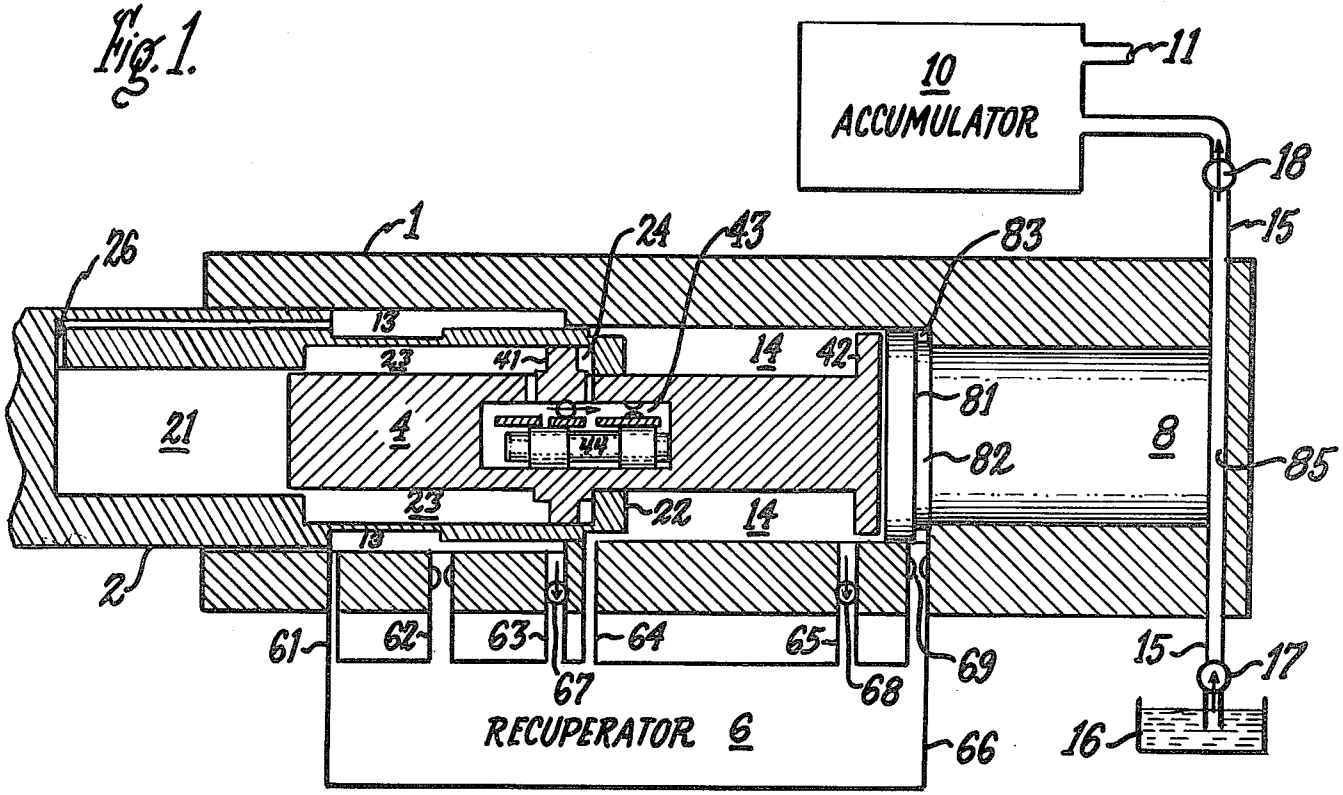
FIG. 1 is an illustration of an implementation of an ordnance recoil energy control and recovery system in battery position according to the invention in which the recoil energy of the gun is used to charge a gaseous recuperator, the energy stored in the recuperator is used for the return of the gun to battery, and the excess recoil energy is transferred to a hydraulic system having an accumulator.

One embodiment of the invention, as illustrated in FIG. 1, includes a housing 1 having a cylindrical bore into which are fitted a recoil piston 2 attached to the slide of the recoil mass of the gun, a floating piston 4 and a pumping piston 8. Recoil piston 2 also includes a cylindrical bore receiving one end of the floating piston 4 to form cylindrical chamber 21, an enlarged bore portion receiving a raised ring portion 41 of the floating piston 4 and a terminal annular portion 22 which is fitted to the floating piston to define a separation between two chambers.

This configuration of housing 1, recoil piston 2, and floating piston 4 creates two annular chambers 13 and 14 which, along with cylindrical chamber 21, define a variable gas volume for absorbing the recoil energy from the gun. Recoil gas chambers 13 and 14 are connected to a recuperator 6 by means of conduits 61 through 65 for the transfer of gas between the recuperator and those chambers. Cylindrical recoil chamber 21 is connected to chamber 13 by means of conduit 26 in the recoil piston. The recoil energy from firing the gun is collected into the recuperator by means of a gas, such as nitrogen, which initially filled the recuperator and chambers 21, 13 and 14 at a selected pressure. As the gun recoils, recoil piston 2 is moved to the right as viewed in FIG. 1, collapsing chambers 13, 14 and 21 driving the gas from those volumes into the recuperator through conduits 63 and 65 in which are located check valves 67 and 68 to permit only one way movement of the gas. At the termination of the recoil, the recoil energy has been transferred into gaseous pressure in recuperator 6.

Figure 2:
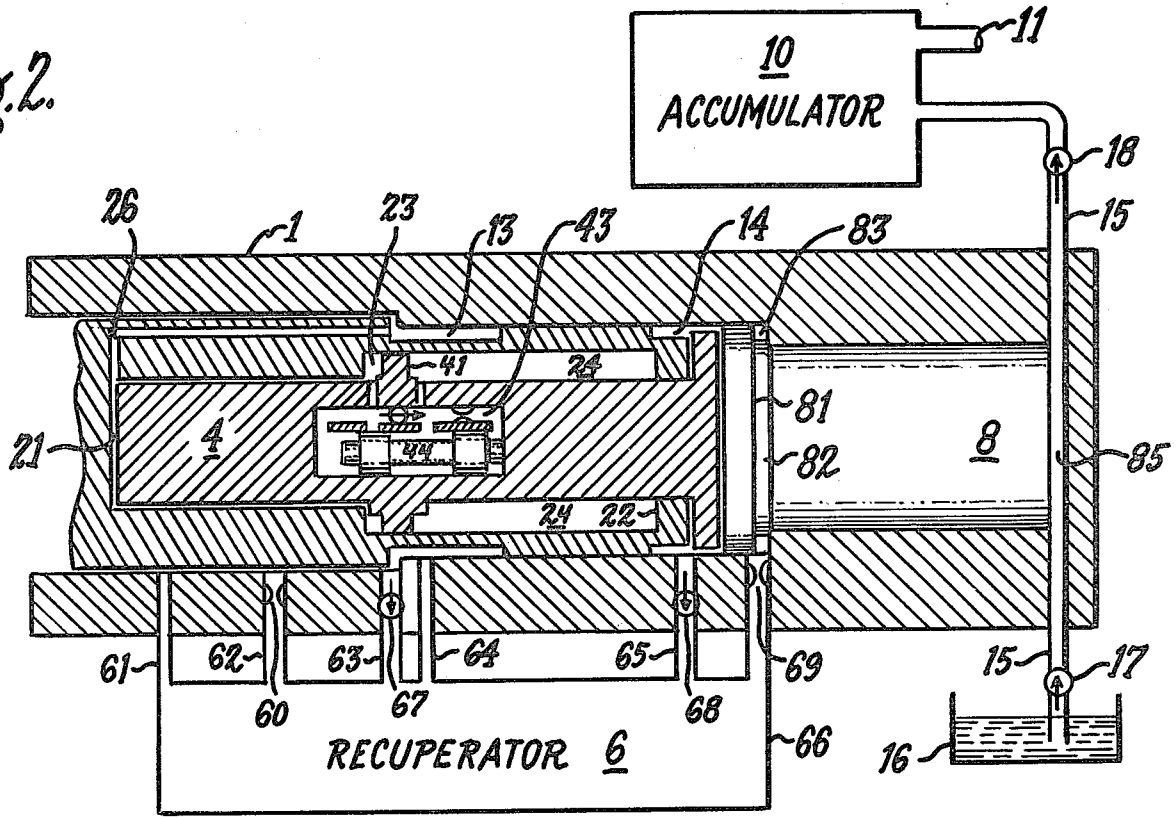
FIG. 2 is an illustration of the embodiment of the system of FIG. 1 with the recoil mechanism in recoil position.

The configuration of the enlarged portion of the cylindrical bore in recoil piston 2 and the central ring portion 41 of the floating piston 4 creates two additional annular chambers 23 and 24. Floating piston 4 also contains an interior valving structure 43 including a cavity having some interior ducting, a shuttle valve 44, a check valve in the ducting, and conduits connecting the cavity on either side of the check valve with annular chambers 23 and 24 respectively. This system, when filled with hydraulic fluid, controls movement of the floating piston 4 during various stages of the operation by changing it from a floating piston to a locked piston. When the gun is in battery position, as illustrated in FIG. 1, the volume of hydraulic chamber 23 is at its maximum and the volume of chamber 24 is at its minimum. On recoil of the gun, movement of recoil piston 2 to the right, as viewed in FIG. 1, causes the hydraulic fluid contained in chamber 23 to flow through the conduits and ducting interconnecting those chambers as permitted by the unidirectional check valve so that at full recoil position, chamber 24 is at its maximum volume and chamber 23 is at its minimum volume as shown in FIG. 2. This condition cannot be reversed until sufficient pressure is placed on the hydraulic fluid in chamber 24 to cause shuttle valve 44 to move to the left, uncovering the ports in the valving structure to permit return of hydraulic fluid to chamber 23.

The remainder of the structure includes hydraulic fluid conduit 15 interconnecting a hydraulic sump 16, the cylindrical bore in housing 1 and an accumulator 10. A hydraulic pumping piston 8 is also fitted into a reduced portion of the cylindrical bore in housing 1 with a portion of it being enlarged to constitute flange 81 which is journalled into a larger portion of the bore. An intermediate portion 82 of the pumping piston is intermediate in size between the main portion of the piston and flange 81 so that piston 8, as illustrated in FIG. 1, constitutes the extreme right position that it can assume. Although intermediate portion 82 is of sufficiently large diameter to limit movement of piston 8 toward conduit 15, it does not entirely fill the enlarged portion of the bore as does flange 81 so as to leave an annular chamber 83 at all times. Hydraulic conduit 15 further includes check valves 17 and 18 which permit the hydraulic fluid in the hydraulic accumulator system to move only in the direction from the sump to the accumulator.

When the recoil mass is in the recoil position at the end of the recoil stroke, the configuration of the device is as illustrated in FIG. 2 which shows that chambers 13, 14 and 21 have been reduced to their minimum volumes forcing the gas into recuperator 6 and that hydraulic fluid initially located in chamber 23 has been forced through the check valve within the valving structure 43 into chamber 24. With the components in this recoil position, the recuperator is vented only through conduit 66 to chamber 83 through metering valve 69, which can be merely an orifice, and through unrestricted conduit 64 into a minimum volume chamber 13. The gas flow through conduit 64 into chamber 13 acts on the exterior annular surface of piston 2 facing conduit 64 to start to drive the slide in counterrecoil movement with unrestricted gas flow until chamber 13 passes beyond the outlet of conduit 64 at which time flow through conduit 64 is cut off. As the unrestricted flow of gas through 64 for counterrecoil drive is cut off by piston 2, the restricted conduit 62 is uncovered to continue the counterrecoil drive at a controlled rate with a metered flow of gas from the recuperator. As piston 2 approaches battery position, both unrestricted conduits 61 and 64 are uncovered to permit the full use of the recuperator gas to firmly seat and lock the recoil mass in battery.

During the counterrecoil period, the recuperator gas pressure is also vented to chamber 83, as noted above, through metered conduit 66 where it acts on the annular surface of flange 81 on pumping cylinder 8 to drive hydraulic pumping piston 8 to the left at a slower rate than that of piston 2 so that hydraulic pumping chamber 85 is filled with fluid drawn from sump 16 at an efficient flow rate. Although this implementation provides for a separate piston 8 moving separately from piston 2, there is no reason why the concept could not be implemented by a design in which pistons 2 and 8 were a single structure if that design made proper allowance for flow of the hydraulic fluid from sump 16 to chamber 85 at an efficient rate for the viscosity of the fluid used. In such design, the relationships among conduits 61, 62, 64 and 66 might be changed or the application of the gas for counterrecoil be restructured.

By the time that the recoil mass is set in battery and pumping piston 8 has followed to an extreme left-hand position (not illustrated) as stopped by piston 4 causing pumping chamber 85 to be at its maximum capacity are filled with hydraulic fluid from sump 16, the full remaining gas pressure of the recuperator is available to chambers 13 and 14 through unrestricted conduits 61 and 4 are from chamber 13 through conduit 26 to chamber 21.

That pressure in chambers 21 and 14 exert a force on the left end of floating piston 4 and on the annular surface of flange 42 forming an end wall of chamber 14 to drive piston 4 to the right toward its FIG. 1 position. The surfaces exposed to chambers 21 and 14 are substantial as compared with the annular surface on flange 81 of pumping piston 8 which is exposed to the same recuperator pressure through conduit 66 and, therefore, the force applied to the former surfaces is capable of driving pistons 4 and 8 to the right to the position of FIG. 1. However, movement of floating piston 4 to the right is initially blocked by the hydraulic latching mechanism including chambers 23 and 24, the valving structure 43 and the hydraulic fluid contained in those volumes. As pressure is exerted on the hydraulic fluid in chamber 24, the check valve in the valving structure closes and the hydraulic fluid from 24 can escape only into the space filled by shuttle valve 44. This valve is designed so that there is a bias in favor of the hydraulic fluid pressure exerted on the right-hand end of the shuttle valve through the metering valve (orifice) in the ducting on the right side of valving structure which forces the shuttle valve to the left. This opens a direct passage between chamber 24 and chamber 23 with the result that the hydraulic latching mechanism no longer exerts a resistance to the movement of piston 4 to the right changing piston 4 from a locked piston back to a floating piston to let it return to the FIG. 1 position. The net result is that hydraulic pumping piston 8 is forced to the right and reduces the volume of hydraulic pumping chamber 85 to its original position by forcing hydraulic fluid from that chamber into the accumulator through check valve 18. By the time the components return to the FIG. 1 position, there has been a transfer of energy from the pressurized gas in the recuperator to the accumulator of the hydraulic system, making that energy available in the form of pressurized hydraulic fluid in pipe 11 for use elsewhere.

Figure 3:
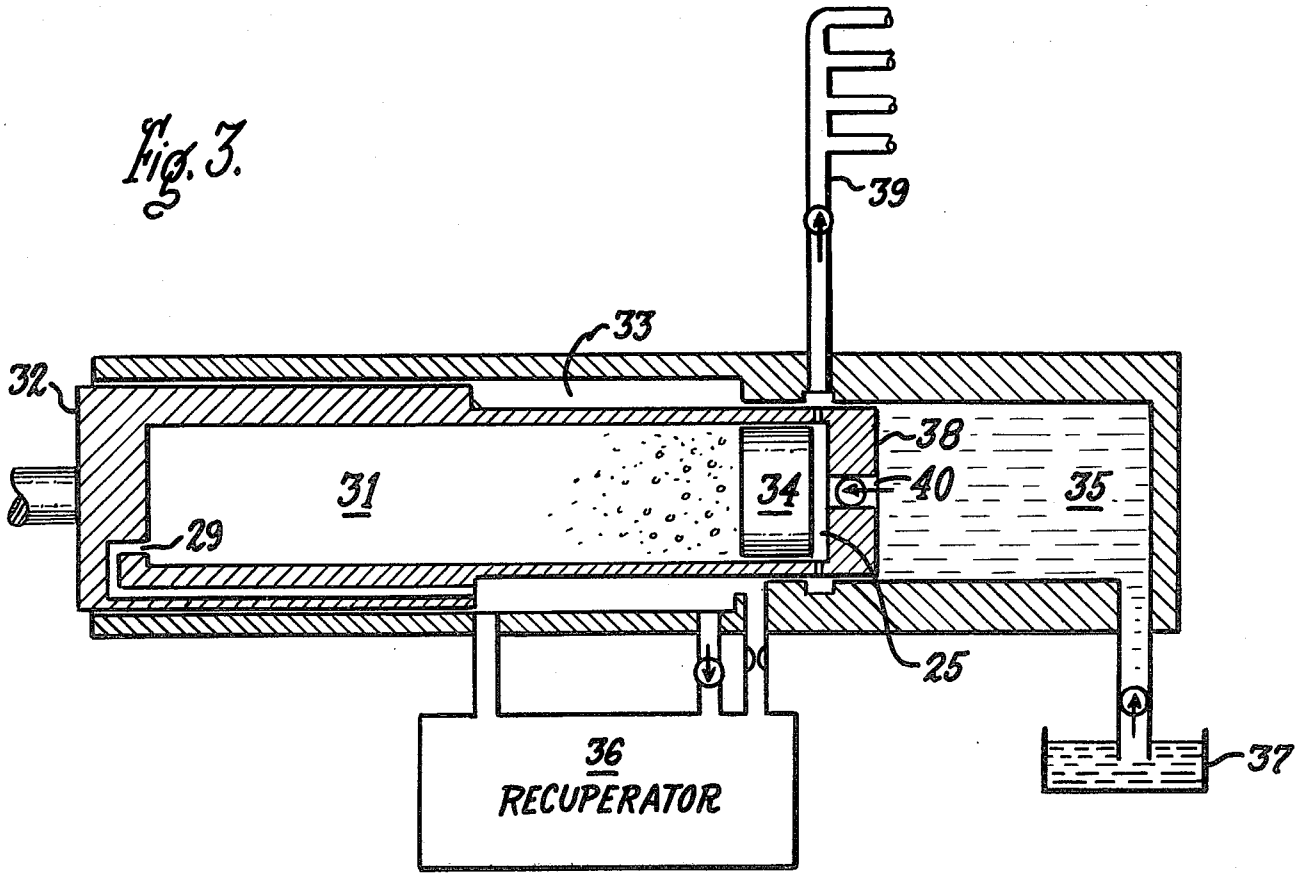
FIG. 3 is a schematic illustration of a simplified implementation of the invention wherein the hydraulic accumulator is a part of the basic structure.

A simplified version of the structure to implement the invention is depicted in FIG. 3 wherein recoil piston 32 which is a part of the recoil mass of the gun corresponds to, and serves a function similar to, that of recoil piston 2 of the FIG. 1 version. The recoil piston 32 which is of two different external diameters is fitted into a two diameter bore in a housing 30 in such a way that it defines a variable volume chamber 33 corresponding to chambers 13 and 14 in FIG. 1 and which is in communication with recuperator 36 through conduits which include one which is interdicted by a check valve, one which contains a metering valve and one which is unobstructed. Piston 32 and the housing also define a hydraulic fluid chamber 35 which is in communication with a sump 37 by means of a conduit containing a check valve and with a hydraulic pressure distribution system 39 which is also connected by means of a conduit containing a check valve.

Recoil piston 32 includes an interior cylindrical chamber 31 corresponding to the chamber 21 of FIG. 1 and contains a true floating piston 34 but unlike the FIG. 1 version, recoil piston 32 has a portion 38 closing its right-hand end constituting a hydraulic bucket. Chamber 31 is connected to annular chamber 33 by means of conduit 29. In this implementation of the invention, recoil forces piston 32 to the right as far as permitted by the configuration of piston and housing, forcing the gas with which chambers 31 and 33 are charged into recuperator 36 where the recovered recoil energy is represented by an increase in gas pressure. During recoil, the hydraulic fluid with which hydraulic chamber 35 is initially charged is put under pressure and, since it cannot escape back into the sump through the check valve in that line, passes through the one-way passage 40 in bucket 38 to the space between floating piston 34 and bucket 38 holding floating piston 34 relatively stationary during recoil and creating between piston 34 and bucket 38 a temporary fluid filled hydraulic pumping chamber 25 which, of course, moves with piston 32 on counterrecoil. Chamber 35, therefore, serves as a variable capacity fluid loading chamber as it serves to load or charge pumping chamber 25 with hydraulic fluid. On completion of the recoil stroke, with the gaseous pressure in the recuperator being vented only through the conduit containing the metering valve to chambr 33, the recoil piston is driven back to battery position by means of gaseous pressure in chamber 33. As this happens, the check valve in the one-way passage 40 automatically closes and a quantity of hydraulic fluid, roughly equivalent to the content of hydraulic chamber 35, is drawn along with a corresponding displacement of floating piston 34 toward the gun, i.e., to the left as viewed in FIG. 3. On return of recoil piston 32 to battery, recuperator pressure is then available through the unrestricted conduit into chamber 33 and thence through conduit 29 into chamber 31 where the pressure either causes the structure to act as a self-contained accumulator or can be used to perform a hydraulic pumping step to force the hydraulic fluid into an external accumulator in system 39 similar to that which was explained with reference to FIG. 1. To use housing 30, chamber 31 and floating piston 34 as a self-contained accumulator, it is efficacious to design the system, including sizing chambers 31 and 35, to permit storage of hydraulic fluid and gas pressures in excess of one firing cycle so that successive firings are not dependent upon dissipation of the stored energy.

Figure 4:
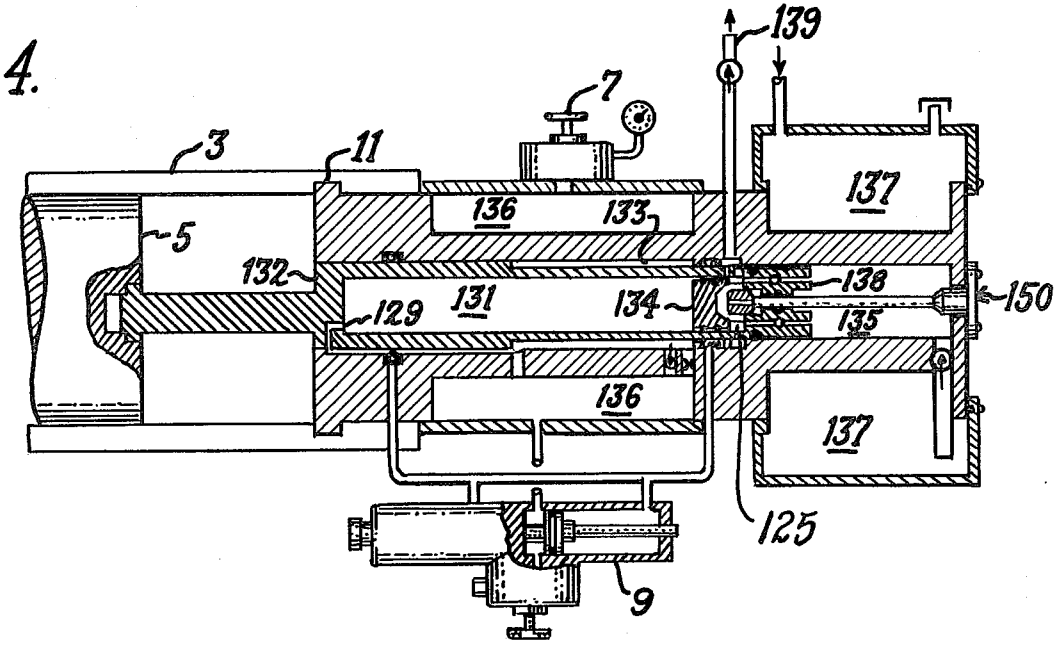
FIG. 4 is a preferred embodiment of the invention which is more specifically an adaptation of the invention to a specific existing piece of ordnance, to wit, a U.S. Navy 5", 38 caliber gun.
Figure 5:
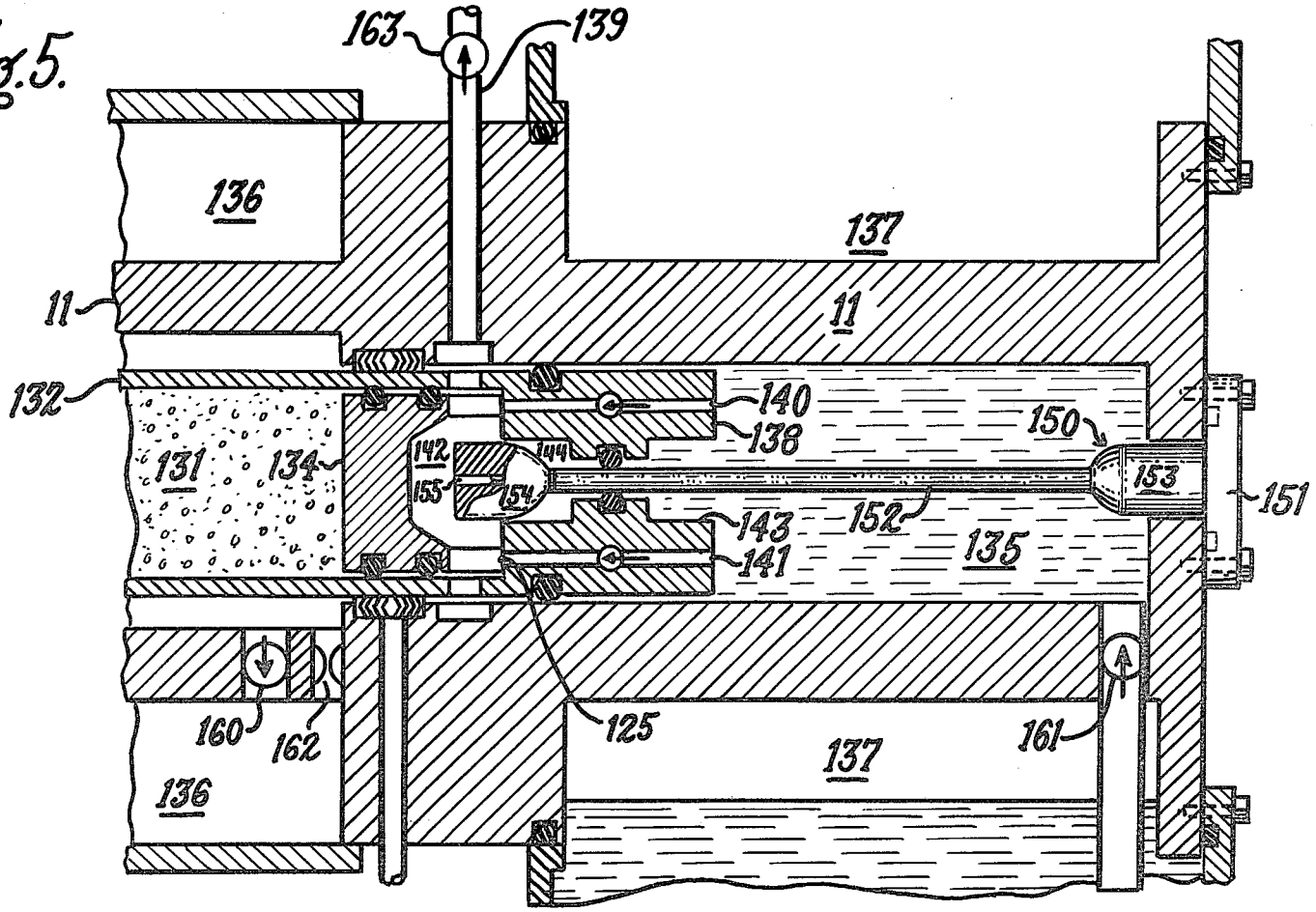
FIG. 5 is a detailed of that portion of the structure of FIG. 4 which provides for the exchange of energy between the gaseous recuperator and the hydraulic system.

FIGS. 4 and 5 illustrate the preferred embodiment of this invention and, in view of the fact that this implementation is a preliminary design of a proposed modification of an existing piece of ordnance, it is currently regarded as the best mode contemplated for carrying out of the invention. FIG. 4 shows the invention applied to a 5" 38 caiber gun wherein slide 3 contains a modified rear plate 11 which forms a housing comparable to the housing 1 of FIG. 1 or the housing 30 of FIG. 3. A recoil piston 132 is fittled into an elongated bore in the housing 11 and is secured to the recoil mass 5 of the gun. The implementation of the invention by means of gas chamber 131 within recoil piston 132, annular chamber 133 between the recoil piston 132 and housing 11 and hydraulic bucket 138 in hydraulic chamber 135 is comparable to and operates substantially as does the implementation of FIG. 3 and will be explained in detail with respect to the enlarged cut of the critical portion illustrated in FIG. 5. Other features shown in FIG. 4 include a nitrogen charging system 7 and a differential piston assembly 9 which is used to control packing pressures at the bearing surfaces responsive to operating conditions. Insofar as the operating components are concerned, the difference between the FIG. 4 embodiment and that shown in the simplified version of FIG. 3 is in the implementation of the floating piston and the right-hand portion of the recoil piston which has been referred to as the hydraulic bucket. These differences can be best appreciated by reference to FIG. 5.

In the preferred embodiment of FIG. 5, as recoil takes place, the recoil piston 132 is driven to the right collapsing chambers 131 and 133 forcing the contained gas through check valve 160 into the recuperator 136 with the gas contained in cylindrical chamber 131 passing into annular chamber 133 by means of conduit 129 illustrated in FIG. 4. As the hydraulic bucket 138 portion of the piston moves to the right, hydraulic fluid contained within the hydraulic loading chamber 135 is prevented from returning to sump 137 by means of check valve 161 and is, therefore, forced through one-way passages 140 and 141 into the interiorly recessed portion 142 of floating piston 134 and into the space between the floating piston and the bucket to form hydraulic pumping chamber 125. The flow of hydraulic fluid through the passages 140 and 141 to fill the space between the floating piston and bucket 138 will prevent the floating piston from following the bucket to the right. On completion of recoil, the gas pressure in recuperator 136 returns the recoil piston 132 to battery in a counterrecoil or run out stroke by passing through metered valve 162 to expand annular chamber 133 without expanding chamber 131 and moves the floating piston and the newly created hydraulic pumping chamber 125 to the left along with recoil piston 132 and its bucket 138. The recoil piston and the remainder of the recoil mass predriven to battery position utilizing only a part of the gas pressure in the recuperator and thereby leaving pressure converted form of a substantial portion of the recoil energy. With the recoil piston returned to battery, bucket 138 is again in the position illustrated in FIGS. 4 and 5 but recoil piston 134 is substantially displaced to the left of the position illustrated. This system is then in a configuration in which the hydraulic fluid in the hydraulic distribution system 139 is under the pressure of the gas in the recuperator as a result of its action on floating piston 134 in gas chamber 131. As noted, with respect to the implementation of FIGS. 4 and 5, the hydraulic distribution system 139 which contains at least one check valve as illustrated at 163 can be used directly to power other mechanisms or can charge an exterior accumulator as, for example, similar to that illustrated in FIG. 1. In either event, energy from the recoil has been recovered and is available for use in driving auxiliary equipment. As noted with respect to FIGS. 4 and 5, this preferred embodiment is designed with sufficient capacity to cause chambers 131 and 125 to constitute a built-in accumulator which need not be returned to the condition illustrated in FIGS. 4 and 5 between each shot. The embodiment of FIGS. 4 and 5 contains a buffer rod assembly 150 which was not incorporated into the simplified version of FIG. 3. This buffer assembly secured to the housing by means of a plate 151 is an implementation of a conventional snubbing device and includes a buffer rod 152 and impact elements 153 and 154 which, in cooperation with cut-away portions 143 and 144, impact element 154 includes a passageway 155 to permit hydraulic fluid trapped within cut-away portion 144 to escape on impact of bucket 138 with the impact element 154 as the recoil mass returns to battery.

It is also understood that the concepts and structures disclosed and described although particularly pertinent to ordnance as implemented would have applicability in industry as, for example, in connection with equipment for explosive forming.

We claim:

1. A recoil mechanism for controlling movement of a recoil mass relative to a mount comprising:

(a) a pressurized gas recuperator system including available capacity gas chamber means interconnecting said recoil mass and said mount for opposing recoil, for collecting recoil energy in the form of gas pressure in a gas recuperator as recoil movement of said recoil mass decreases the capacity of said variable capacity gas chamber means forcing gas therefrom into said gas recuperator, for driving said recoil mass in counterrecoil with use of only part of said collected energy and for transferring the remainder of said collected energy to another system subsequent to counterrecoil;

(b) a hydraulic accumulator system for supplying, holding and distributing hydraulic fluid under pressure including a variable capacity hydraulic pump chamber; and (c) interface means responsive to said gas recuperator means for utilizing gas pressure collected in said recuperator for reducing the capacity of said hydraulic pump chamber to force hydraulic fluid from said chamber under pressure to effect a transfer of recoil energy from gas pressure to hydraulic pressure, whereby recoil energy can be generated and collected in the form of gas pressure during recoil, partially dissipated to drive the recoil mass in counterrecoil and thereafter transferred to a hydraulic system for use.

2. In a recoil mechanism for permitting and controlling movement of a recoil mass relative to a mount in response to a driving force, the improvement comprising:

(a) a gas pressure recuperator system including variable capacity gas chamber means and a recuperator reservoir interconnected by gas conduits for absorption of recoil energy by compressing gas from said gas chamber means into said recuperator reservoir responsive to decreasing the capacity of the gas chamber means by recoil motion of the recoil mass and for driving said recoil mass in counterrecoil by partial expansion of said gas chamber means by pressure in said recuperator reservoir;

(b) a hydraulic system including a variable capacity hydraulic cylinder, means for charging said cylinder with hydraulic fluid including a hydraulic reservoir and interconnecting hydraulic lines and hydraulic lines for movement of hydraulic fluid from said hydraulic cylinder under pressure for transfer and use of energy in the form of pressurized hydraulic fluid; and (c) energy transfer means for transfer of energy from said recuperator system to said hydraulic system after counterrecoil movement of the recoil mass including interface means for movement responsive to a change in the capacity of said gas chamber means to reduce the capacity of said hydraulic cylinder responsive and proportional to expansion of said gas chamber means from its partial expanded state to its full capacity.

3. The improvement in recoil mechanism of claim 2 wherein:

said means for charging said hydraulic cylinder with hydraulic fluid includes pump and hydraulic flow control means utilizing energy derived from recoil of said recoil mass for filling said hydraulic cylinder with hydraulic fluid.

4. The improvement in recoil mechanisms of claim 3 wherein:

said gas chamber means includes:

a first variable capacity gas chamber between said recoil mass and said mount having a maximum capacity when the recoil mass is in battery position and a minimum capacity when the recoil mass is in recoil position, a second variable capacity gas chamber defined by a portion of said recoil mass and a portion of said interface means of said energy transfer means, and additional gas conduits interconnecting said first and second gas chambers; and said energy transfer means includes means for causing said interface means to resist movement during recoil, to travel with said recoil mass during counterrecoil and to be moveable independently of both said recoil mass and said mount subsequent to recoil, whereby said second gas chamber is collapsed on recoil to convert recoil energy into gas pressure, is retained in collapsed condition during counterrecoil and is expanded subsequent to counterrecoil to convert the residual gas pressure into pressure in said hydraulic system.

5. The improvement in recoil mechanisms of claim 4 wherein:

said interface means comprises free piston means between a cylinder in said recoil mass which comprises said second gas chamber and a cylinder in said mount which comprises said hydraulic cylinder;

said means for causing said interface means to resist movement, to travel with and to be moveable independently comprises means to lock said free piston means to said recoil mass during counterrecoil; and a portion of said free piston means in cooperation with said hydraulic cylinder comprises the pump portion of said pump and hydraulic flow control means for filling said hydraulic cylinder.

6. The improvement in recoil mechanisms of claim 5 wherein:

said free piston means includes:

a first free piston in the said cylinder comprising said second gas chamber, and a second free piston in the said cylinder comprising said hydraulic cylinder;

said free pistons being proximate and aligned to permit the one said piston to drive the other; and said cylinder in said mount and said second free piston also defining a third gas chamber responsive to gas pressure in said recuperator reservoir for driving said second free piston to comprise said pump portion of said pump and hydraulic flow control means for filling said hydraulic cylinder.

7. The improvement in recoil mechanisms of claim 4 wherein:

said interface means comprises free piston means within a cylinder in said recoil mass, said free piston means dividing said cylinder into two portions comprising said second gas chamber and said hydraulic cylinder respectively.

8. The improvement in recoil mechanisms of claim 4 wherein:

said recoil mass includes a recoil piston journaled within a recoil cylinder in said mount for the reciprocal movement of recoil and counterrecoil with the end of said recoil piston being proximate a closed end of said recoil cylinder at the end of the recoil stroke and spaced therefrom when in battery to form a variable capacity hydraulic fluid loading chamber comprising said pump of said means for charging said hydraulic cylinder;

said recoil piston and said recoil cylinder having complementary offset side wall portions forming said first variable capacity gas chamber;

said recoil piston itself containing an internal cylinder and free piston means separating said internal cylinder to form said variable capacity gas chamber, said variable capacity hydraulic cylinder and said interface means; and said recoil piston having conduits to permit one way flow of hydraulic fluid from said loading chamber to said hydraulic cylinder and from said hydraulic cylinder to hydraulic lines for movement of hydraulic fluid from said hydraulic cylinder under pressure, whereby recoil forces fluid from said loading chamber to said hydraulic cylinder and counterrecoil moves said hydraulic cylinder and refills said loading chamber and whereby subsequently to counterrecoil gas pressure from said recuperator reservoir can expand said second gas chamber by moving said free piston means to expel fluid from said hydraulic cylinder.

9. In an ordnance recoil mechanism for permitting movement of a recoil mass relative to a gun mount and to absorb firing reaction energy, the improvement comprising:

(a) a closed cycle gas chargeable recuperator system including:

(1) a recuperator for storing pressurized gas, (2) variable capacity gas chamber means, (3) gas conduit means interconnecting said recuperator and said gas chamber means, (4) means for substantially collapsing said gas chamber means responsive to recoil to force gas from said gas chamber means into said recuperator, and (5) means responsive to gas pressure in said recuperator to return said recoil mass to battery by partially returning said gas chamber means to its original capacity;

(b) a hydraulic system including:

(1) a reservoir for storing hydraulic fluid, (2) variable capacity hydraulic chamber means, (3) hydraulic conduit means for conducting hydraulic fluid from said reservoir to said hydraulic chamber means and from said hydraulic chamber means under pressure, and (4) means responsive to movement of said recoil mass for charging said hydraulic chamber means with hydraulic fluid from said reservoir; and (c) independently moveable means interposed between said variable capacity gas chamber means and said variable capacity hydraulic chamber means for reciprocally varying the capacity of said chamber means for transfer of energy from said recuperator system to said hydraulic system responsive to pressure in said recuperator.

10. The improvement of claim 9 wherein:

said gas chamber means is a compound chamber defined by portions of said recoil means, said mount and said independently moveable means, whereby recoil movement of the recoil mass with said independently moveable means being held stationary relative to said mount will decrease the volume of said gas chamber means to a minimum volume driving gas from said compound chamber into said recuperator increasing the gas pressure therein, and whereby said recoil mass can be driven in counterrecoil by said gas pressure by increasing the volume of said gas chamber from said minimum volume to a partial volume with said independently moveable means being held stationary with respect to said recoil mass.

11. The improvement of claim 10 wherein:

said gas chamber means includes:

a first chamber portion defined in part by surfaces of said recoil mass and in part by surfaces of said mount whereby recoil collapses said first chamber portion and whereby said recoil mass can be driven in counterrecoil by expanding said first portion from its collapsed condition, and a second chamber portion defined by surfaces of said recoil mass and of said independently moveable means whereby said second chamber portion may be held at a constant volume during counterrecoil by movement of said free piston means with said recoil mass.

12. The improvement of claim 11 wherein:

said independently moveable means comprises free piston means and means for locking said free piston means to said recoil mass for movement therewith on counterrecoil; and said variable capacity hydralic chamber means is defined by surfaces of said free piston means and surfaces of said mount and is initially at a minimum volume whereby counterrecoil movement of said recoil mass and said free piston means expands said hydraulic chamber, whereby movement of the recoil mass in recoil reduces said gas chamber means to a minimum volume driving gas from said gas chamber into said recuperator and activates said means for locking said free piston means to said recoil mass, and whereby gas pressure in said recuperator expands said first chamber portion of said gas chamber means to drive said free piston means and recoil mass in counterrecoil and expands said variable capacity hydraulic chamber means to maximum capacity.

13. The improvement of claim 12 wherein:

said free piston means comprises:

a first free piston including said surfaces of said independently moveable means defining in part said second chamber portion of said gas chamber means and including said means for locking said free piston means to said recoil mass, and a second free piston including said surfaces of said free piston means defining, in part, said variable capacity hydraulic chamber means;

said first and second free piston means being axially aligned and having opposing surfaces for one to drive the other; and said means responsive to movement of said recoil mass for charging said hydraulic chamber means includes an additional variable volume gas chamber defined by surfaces of said second free piston and surfaces of said mount, unidirectional valve means in said conduit means for conducting hydraulic fluid and gas conduit means interconnecting said recuperator and said additional variable volume gas chamber, whereby said second free piston is driven by said gas pressure in the counterrecoil direction independently of, but more slowly than, said recoil mass to charge said variable capacity hydraulic chamber means at a more efficient rate.

14. The improvement of claim 11 or claim 13 further comprising an accumulator for storage of hydraulic fluid under pressure connected to said hydraulic conduit means for conducting hydraulic fluid from said hydraulic chamber means under pressure, whereby recoil energy in the form of residual gas pressure in said recuperator subsequent to counterrecoil can be transferred to said accumulator by having said gas pressure expand said second chamber portion of said gas chamber means to force said independently moveable means to its ready-for-firing position reducing said variable capacity hydraulic chamber means to its minimum capacity forcing hydraulic fluid through said conduit means for conducting hydraulic fluid to said accumulator.

15. The improvement of claim 11 wherein:

said mount includes cylinder means having a closed end;

said recoil mass includes recoil piston means journaled in said cylinder means for reciprocating movement therein with recoil and counterrecoil of the recoil mass;

said recoil piston means and said cylinder means having complementary offset wall portions defining said first chamber portion of said gas chamber means;

said recoil piston means itself containing a closed cylinder coaxial with said cylinder means;

said independently moveable means comprises free piston means journaled in said closed cylinder, dividing said closed cylinder into two parts, one part of which is on the same side of said free piston means as said closed end of said cylinder means comprises said variable capacity hydraulic chamber means, the other part of which comprises said second chamber portion of said gas chamber means;

the end of said recoil piston proximate said closed end of said cylinder means and said closed end defining a variable capacity hydraulic fluid loading chamber comprising a portion of said conduit means for conducting hydraulic fluid from said reservoir to said hydraulic chamber means;

said end of said recoil piston proximate said closed end of said cylinder means containing unidirectional fluid passage ways for permitting flow of hydraulic fluid from said loading chamber to said variable capacity hydraulic chamber means; and said recoil piston containing gas pipe means for permitting flow of gas between said first and said second chamber portions of said gas chamber means.

whereby, when said systems are charged with gas and oil respectively, recoil of said recoil mass toward said closed end of said cylinder means collapses said first chamber portion of said gas chamber means forcing gas into said recuperator, collapses said fluid loading chamber forcing hydraulic fluid through said unidirectional fluid passageways into said variable capacity hydraulic chamber means applying hydraulic pressure to one side of said free piston means holding said free piston means from movement with said recoil piston to collapse said second chamber portion of said gas chamber means, whereby, after recoil, pressurized gas in said recuperator expands said first chamber portion of said gas chamber means driving said recoil piston means, said free piston means, said second chamber portion, said hydraulic chamber means, and said recoil mass in counterrecoil, and expands said fluid loading chamber, and whereby, after recoil, residual gas pressure in said recuperator can expand said second chamber portion of said gas chamber means by driving said free piston means to collapse said variable capacity hydraulic chamber means by expelling hydraulic fluid through said hydraulic conduit means for conducting hydraulic fluid from said hydraulic chamber means under pressure.

* * * * *

UNITED STATES PATENT AND TRADEMARK OFFICE

CERTIFICATE OF CORRECTION

PATENT NO. : 4,296,670

DATED : October 27, 1981

INVENTOR(S) : Robert P. Northup et al.

It is certified that error appears in the above—identified patent and that said Letters Patent is hereby corrected as shown below:

Column 11, line 44, "hydralic" should read -- hydraulic --.

Column 13, line 5, "chamber means." should read

-- chamber means, --.

Signed and Sealed this

*Nineteenth* Day of *January 1982*

[SEAL]

*Attest:*

GERALD J. MOSSINGHOFF

*Attesting Officer*

*Commissioner of Patents and Trademarks*